US005209155A

United States Patent [19]

Szewczyk

[11] Patent Number: 5,209,155

[45] Date of Patent: May 11, 1993

[54] RADIAL PISTON ENGINE

[75] Inventor: Mattias Szewczyk, Witten, Fed. Rep. of Germany

[73] Assignee: Paul Pleiger Maschinenfabrik GmbH & Co. KG, Witten, Fed. Rep. of Germany

[21] Appl. No.: 806,879

[22] Filed: Dec. 12, 1991

[30] Foreign Application Priority Data

Dec. 19, 1990 [DE] Fed. Rep. of Germany ..... 4040738

[51] Int. Cl.[5] ..... F01B 13/06

[52] U.S. Cl. ..... 92/58; 92/72; 92/157; 91/488

[58] Field of Search ..... 92/72, 157, 148, 58; 91/488; 417/273

[56] References Cited

U.S. PATENT DOCUMENTS

| | | | |
|---|---|---|---|
| 2,674,196 | 4/1954 | Ferris | 92/157 |
| 3,255,706 | 6/1966 | Eickmann | 92/58 |
| 3,789,741 | 2/1974 | Hallberg | 91/488 |
| 4,366,747 | 1/1983 | Falendyse et al. | 92/72 |
| 4,478,133 | 10/1984 | Eickmann | 91/488 |
| 4,538,965 | 9/1985 | Dantlgraber et al. | 92/157 |
| 4,776,258 | 10/1988 | Eickmann | 92/58 |
| 4,926,744 | 5/1990 | Eickmann | 92/58 |

FOREIGN PATENT DOCUMENTS

| | | |
|---|---|---|
| 2307985 | 11/1976 | France . |
| 1468658 | 3/1977 | United Kingdom . |

*Primary Examiner*—Thomas E. Denion

[57] ABSTRACT

In a radial piston engine having pistons bearing against the circumference of an eccentric, which pistons execute a swivelling motion upon the rotational motion of the eccentric and are in engagement with a guide body, which bears on the radially outer end by a radially outwardly convex spherical-annular bearing face against a concave spherical-annular bearing face in the housing or cylinder cover. To attain complete piston relief, the bearing arrangement is designed such that the guide body (2) is provided with an upper end face (8) which is acted on by the pressure medium over a hydraulically effective plane (de) extending perpendicularly to the longitudinal axis of the guide body (2). The hydraulically effective plane lies in the area of the bearing face (5) on the housing (6) or intersects the face for all swivelling positions of the piston (3).

9 Claims, 4 Drawing Sheets $F_H \leq F_K$

RADIAL PISTON ENGINE

FIELD OF THE INVENTION

The invention relates to a radial piston engine.

BACKGROUND AND PRIOR ART

A radial piston engine of this type, as is known for example in French Published Patent Application 2,296,778, and therein only a partial compensation of the hydraulic forces acting on the guide body of the piston is possible in as much as the pressure-medium acting on the guide body from outside to inside always acts in the same direction on the guide body, whereas the pressure acting in the opposite direction from inside to outside, by which the guide body is kept in place against the bearing shell, follows in its alignment the swivelling motion of the guide body, that is to say continually changes the alignment, so that the counteracting compressive forces over the swivelling range cannot be compensated.

This is explained in greater detail with reference to FIG. 1, which diagrammatically shows the known design according to the abovementioned French Published Patent Application. The pressure $p_B$ of the pressure medium, fed in for example via passages in the cylinder cover, which prevails in the pressure space 1 above the guide body 2 over the diameter de of this pressure space exerts a force $F_H$ which remains constant during the swivelling motion of the guide body 2, which engages in a hollow piston 3. In the swivelling position of the piston and guide body represented in FIG. 1, there acts on the underside of the guide body 2, which is provided with clearances for the pressure medium to pass through, the same pressure $p_B$ with the resulting force $F_K$, which keeps the guide body 2 in place with its spherical-annular bearing face 4 against a spherical-annular bearing face 5 of the housing or cylinder cover. Resolving this resultant, a force $F_{KY}$ opposes the bearing relieving force $F_H$ acting on the upper side. The component $F_{KY}$ of the force pressing the guide body against the bearing acts transversely with respect to the longitudinal axis of the guide body 2 and consequently acts transversely on the piston 3.

The equilibrium of the forces in this swivelling position gives a dependence between the permissible degree of bearing relief m and the geometry of the engine as $$m_{por}=F_H/F_K=\cos\alpha-\sin\alpha tg\,\phi.$$

For example, for a swivelling angle $\alpha$ of 10° and $\phi=35°$, a permissible degree of relief of $m_{por}=0.863$ is obtained, without taking frictional forces into account.

If at $\alpha=0$ the working piston is not swivelled, the guide body could theoretically be relieved completely with a hydraulic counterforce $F_H$, which is equal to $F_K$. In this case, the excess of the forces is $1-0.863=0.137$, that is to say virtually 14%, producing an adverse effect on the contact pressure on the spherical-annular face between the guide body and the housing, entailing a corresponding frictional moment. An increased frictional moment on the spherical bearing of the guide body causes the shoe of the piston, not shown in FIG. 1, to lift off from the circumference of the eccentric on one side, producing increased frictional and leakage losses in this area, because pressure medium is passed via restricting bores onto the underside of the piston shoe for relief of the hollow piston.

If the frictional forces N. $\mu$ occurring are also taken into account, the permissible degree of relief is less by a few percent. In order to be able to keep the oscillating guide body reliably in place against the ball seat, a few percent therefore have to be added to this with regard to dimensional and geometrical errors of the ball, so that with the engine data ($\alpha$, $\phi$) specified above an effective degree of relief of about 70 to 75% is obtained.

SUMMARY OF THE INVENTION

The invention is based on the object of designing a radial piston engine of the type described in which the effective degree of relief can be maximized.

This object is achieved according to the invention by the features described hereinbelow. Due to the fact that the spherical-annular bearing face on the housing is dimensioned in relation to the spherical-annular bearing face on the guide body in such a way that, upon the swivelling motion of the guide body, the bearing face on the housing, and not the bearing face on the guide body (as is the case with the above prior art), is partially freed from pressure medium impingement, the relief diameter de on the guide body upon which the relieving force $F_H$ acts follows the oscillating motion of the guide body, so that in each swivelling position a constantly high relief can be obtained which, on account of the constant alignment of the counteracting forces, can also be exactly designed.

BRIEF DESCRIPTION OF THE FIGURES OF THE DRAWING

The invention is described in more detail by way of example with reference to the drawing, in which.

DETAILED DESCRIPTION

Figure 2A:
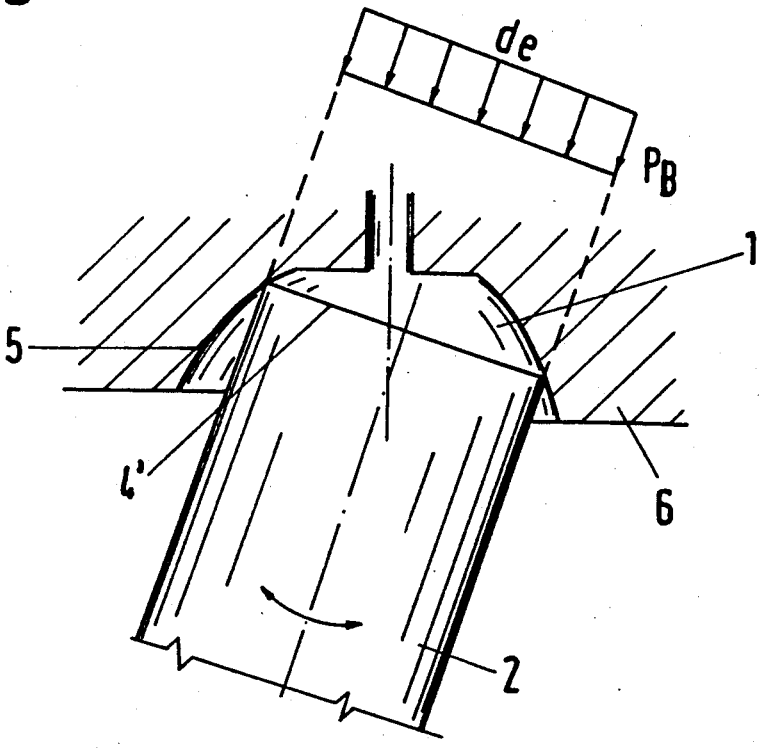
FIG. 2*a* illustrates the design according to the invention in the representation according to FIG. 1*a*.
Figure 2:
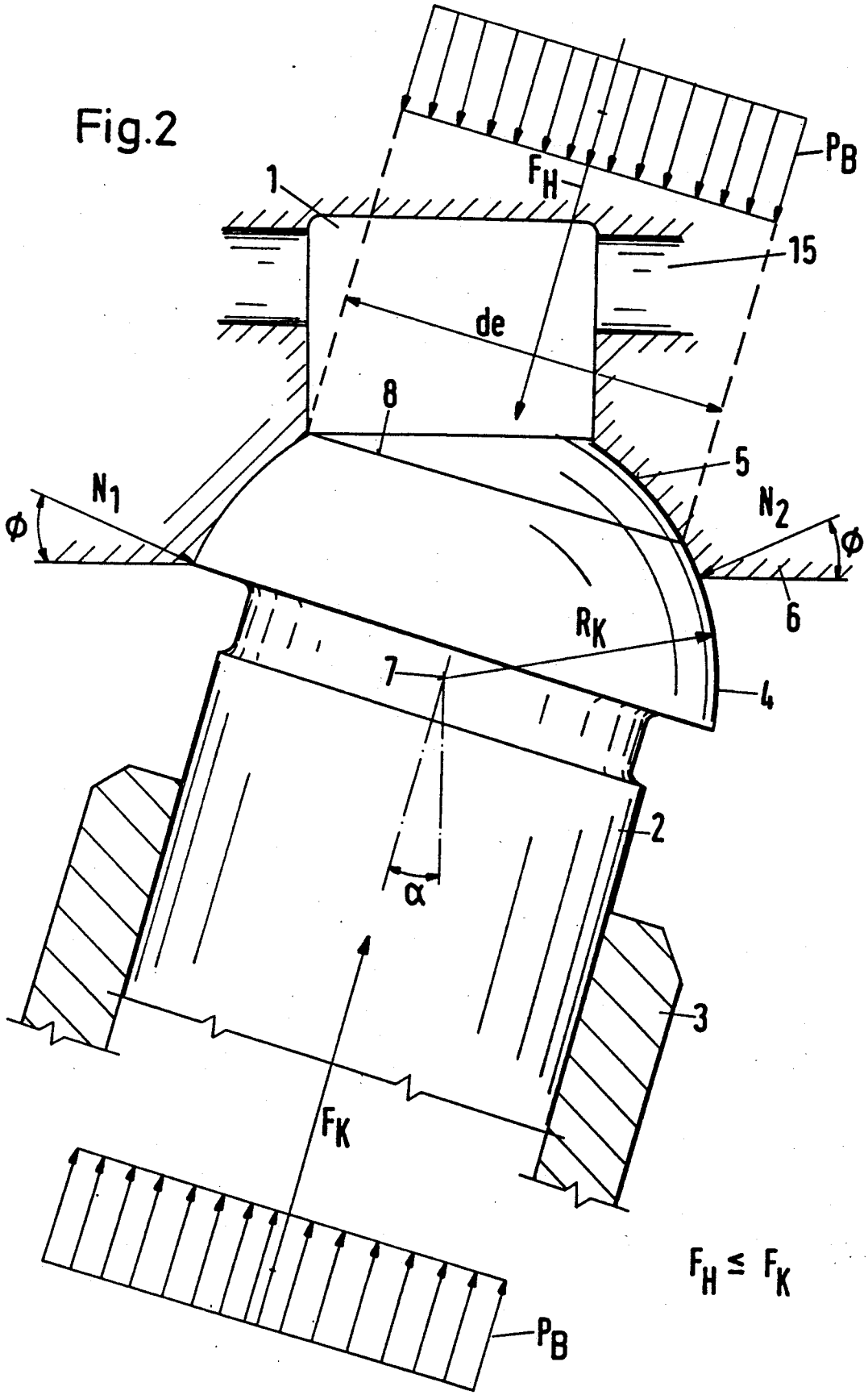
FIG. 2 shows the distribution of forces in the case of the design according to the invention in the same representation as FIG. 1.

In the embodiment according to FIG. 2, the spherical-annular bearing face 4 on the guide body 2 is designed to be approximately the same width as the corresponding spherical-annular bearing face 5 on the housing or cylinder cover 6, so that in the maximum swivelling position shown of the guide body 2, the bearing face 4 of the latter on one side covers the bearing face 5 on the housing 6, whereas on the opposite side the bearing face 5 on the housing 6 is partially freed i.e. exposed to the pressure $P_B$. The width of the spherical-annular bearing face 4, i.e. the dimensions along the longitudinal axis of the guide body 2, can be designed in any way desired. Theoretically, it can reach the extreme value zero, as FIG. 2*a* shows. Consequently, there is no interrelationship between width of the spherical-annular bearing face 4 and the spherical bearing face 5 on the cylinder cover. The spherical bearing face in the cylinder cover must have a certain minimum width, since the spherical-annular bearing face 4 has to transfer only the resulting residual force, unless the degree of relief is 100%.

As a result, the end face 8 of the guide body 2 forming the relief diameter de, i.e. the hydraulically effective plane on which pressure $P_B$ is applied, is constantly acted on by the pressure medium introduced through the pressure space 1, so that the relieving force $F_H$ as the resultant of the compressive pressure $p_B$ follows the swivelling motion and always acts along the axis of the guide body 2.

In the central position at $\alpha=0$, an outer part of the bearing face 5 on the housing 6 is exposed over the entire circumference, so that the relief face on the upper end face 8 of the guide body 2 is subjected to the pressure $p_B$ in the same way as in the maximum swivelling position according to FIG. 2.

Figure 1:
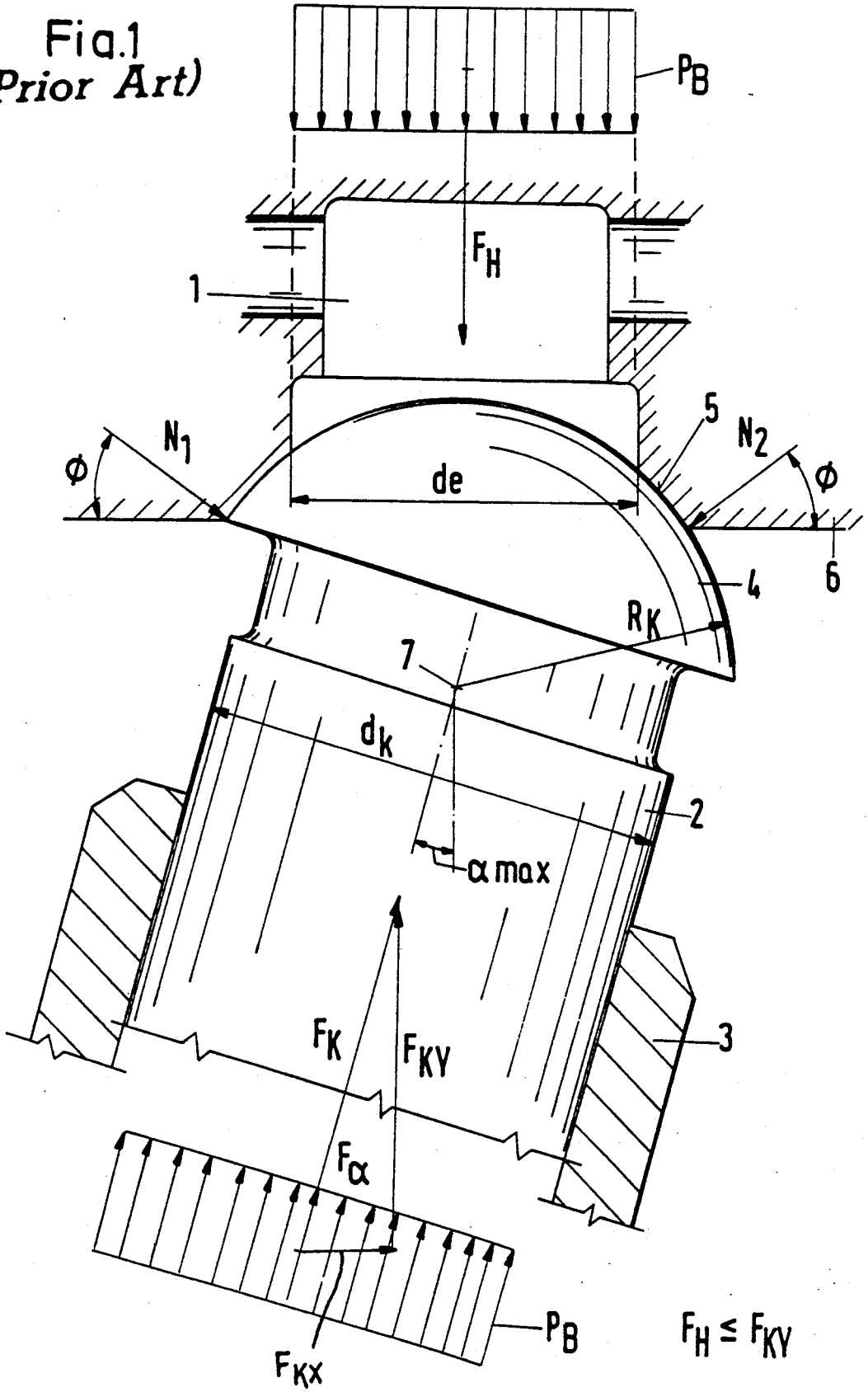
Fig.1 (Prior Art)
FIG. 1 shows the forces acting on the guide body of a piston in a diagrammatic representation in the case of the known design.

In contrast to the known design according to FIG. 1, in the case of the design according to the invention as shown in FIG. 2, the relief face on the end face of the guide body 2 is not formed by a portion of the bearing face 4 on the guide body but only by the straight end face 8, the edges of which brush over the bearing face 5 on the housing 6 during the swivelling motion. In the case of the known design, a sub-area of the bearing face 4 on the guide body 2 is always acted on by the pressure of the pressure medium, so that the relieving force $F_H$ cannot follow the swivelling motion of the guide body 2.

Figure 1A:
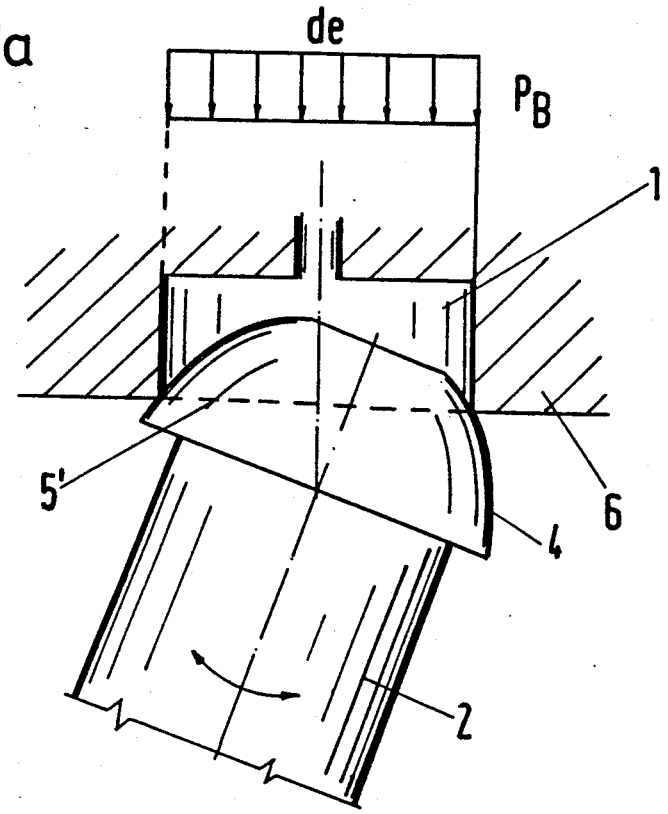
FIG. 1*a* is a diagrammatically simplified representation of this known design.

In the case of the known design, the relief face de is fixed by the approximately cylindrical pressure space 1 in the housing 6, whereas in the case of the design according to the invention the relief face de is fixed on the guide body 2. This is illustrated by the diagrammatic representations in FIGS. 1*a* and 2*a*. In the case of the known design according to FIG. 1*a*, the bearing face on the housing is reduced to a circular sealing edge 5', against which the spherical-annular bearing face 4 of the guide body 2 bears. The pressure space 1 above the guide body is essentially formed by a cylindrical bore or opening having the fixed diameter de. The sealing edge 5' determines the size of the pressure area $p_B$ and consequently also its steady-state position, because the sealing edge 5' does not change during the swivelling motion of the guide body 2.

In contrast to this, in the case of the design according to the invention as shown in FIG. 2*a*, the pressure space 1 above the guide body 2 is formed by an approximately spherical-cup-shaped recess, the bearing face 4 of the guide body 2, reduced to a peripheral edge 4', bearing as sealing edge in this spherical-cup-shaped recess. The diameter de of this circular sealing edge 4' determines the size and position of the pressure area $p_B$ acting on the guide body 2, so that the alignment of the pressure area inevitably follows the alignment of the sealing edge 4', which in the case of this representation is formed by the upper end face 8 of the guide body 2. As a result of the fact that, according to the invention, the cylindrical element 2 in FIG. 2*a* is movable in relation to the fixed element 5 with the concave spherical bearing face, the sealing line 4' between these two elements, together with the associated pressure area, is also movable.

In other words, in the case of the design according to the invention the plane of the relief face de or its projection in the axial direction intersects the spherical-annular bearing face 5 on the housing 6. The width of the bearing face 5 on the housing 6 is essentially determined by the swivelling range of the relief face de running perpendicularly to the longitudinal axis of the guide body 2. This applies for fixing the minimum height of the upper edge of the bearing face 5. The lower edge of the bearing face 5 is designed such that an adequate bearing face for the guide body 2 still remains at the bottom right even in the maximum swivelling position according to FIG. 2.

FIG. 2 shows in the maximum swivelling position of the guide body 2 the minimum height of the upper edge of the bearing face 5 on the housing. As FIG. 2*a* shows, this upper edge may also be higher. In the case of the exemplary embodiment according to FIG. 2, the width of the bearing face 4 on the guide body corresponds to the width of the bearing face 5 on the housing, so that in the maximum swivelling position the two bearing faces overlap completely on one side. However, as explained above, this width of the bearing face 4 is not a requirement.

It is achieved by this configuration of the bearing area between guide body and housing or cylinder cover that the hydraulic relief area and the resulting relieving force $F_H$ is associated with the swivelling guide body. The hydraulic relieving force acts in the same plane or alignment against the reaction force on the radially inner side of the guide body, so that there is no critical position in which lifting-off of the piston has to be feared, because the same frictional moment is applied in each swivelling position. $F_H$ must not be greater than $F_K$, so that the degree of relief is no longer limited by the geometry of the radial piston engine but only by the size of the pressure areas. Theoretically $F_H=F_K$ is possible, so that theoretically the degree of relief would be 100%.

With a high degree of relief, the frictional forces are minimized. This has very positive effects on the frictional moment of the guide body.

Figure 3:
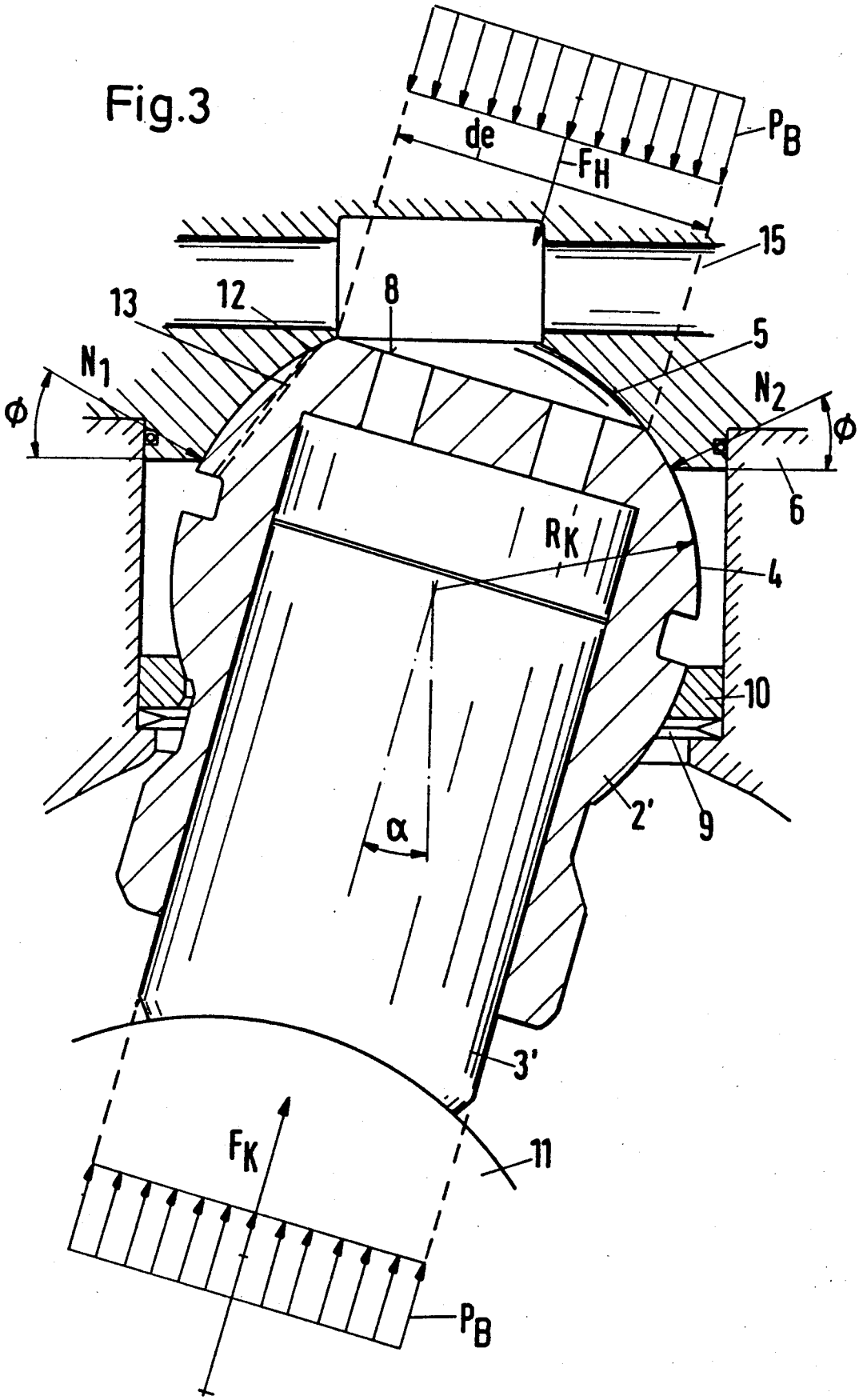
FIG. 3 shows a further embodiment of the design according to the invention.

FIG. 3 shows a design according to the invention, in which the guide body 2' extends over the piston 3'. In the case of this design, the same condition applies, that the plane of the relief face de can be swivelled only in the area of the bearing shell 5 on the housing 6 and not beyond it. The frictional moment on the guide body 2' can be reduced to a minimal value by the fact that only low frictional forces $N.\mu$ occur due to a high degree of relief. Although, for constructional reasons, this design is provided with a relatively large sphere radius $R_K$, which is greater than the piston diameter because the piston enters into the guide body, in this way the frictional moment can nevertheless be kept very small.

In the case of the design according to FIG. 3, the upper part of the guide body 2' is spherical, a supporting ring 10, supported by springs 9, being provided in the lower region of the sphere, the said ring being supported in the housing or in the cylinder cover. The eccentric on the circumference of which the pistons 3' or 3 bear in a sliding manner is indicated in FIG. 3 at 11.

In FIG. 3, an annular groove formed on the bearing face 4 is denoted by 12, which groove is formed close to the end face of the guide body 2' on the circumference of the latter and is constantly connected to the leakage oil space of the radial piston engine via an oblique bore 13. As in the case of the embodiment according to FIG. 2, in the case of the design according to FIG. 3 as well, only a relatively narrow sealing face is necessary between the bearing faces 4 and 5 in order to obtain a high degree of relief and to transfer the remaining forces from $F_K-F_H$, as can also be deduced from FIG. 2*a*. The annular groove 12 is therefore formed near the end face of the guide body 2' in its spherical-annular bearing face 4. As a result, the pressure face is precisely defined on the end face 8 of the guide body 2', since the annular groove 12 reduces the oil pressure in the remaining area of the spherical-annular bearing face 4 via the oblique bore 13. Without this annular groove 12 with relief bore 13, the pressure reduction in the bearing area, and consequently the pressure-relief area, would not be precisely defined. The convex spherical-annular bearing face 4 lying below the annular groove 12 in FIG. 3 serves only for reducing the contact pressure and for better bore guidance in the cylinder cover.

By the design according to the invention, on the one hand the effective degree of relief can be maximized and on the other hand the degree of relief can be predetermined clearly and exactly, because the compressive force acts on the guide body in the direction of the axis of the latter in every swivelling position.

Whereas in the case of the design according to FIG. 2 the piston 3 is designed as a hollow piston and the guide body 2 is designed to correspond to a solid-cylindrical component which enters in the hollow piston, in the case of the design according to FIG. 3 the guide body 2' is provided with a cylindrical recess, in which the piston 3', represented solid-cylindrically, is displaceably guided, so that in the case of this design the guide body 2' extends over the piston 3'.

On the end face 8 of the guide body 2 or 2', elevations or the like may also be formed in the central area. The essential requirement is the presence of the hydraulically effective relief face, determined by the diameter de, which face intersects the bearing face 5 on the housing during the swivelling motion of the piston.

I claim:

1. In a radial piston engine having a rotatable eccentric with a peripheral surface, a piston bearing against said peripheral surface of the eccentric for being driven by said eccentric during rotation thereof, a guide body slidably engaging said piston, said guide body having a longitudinal axis and guiding said piston for travel longitudinally of said guide body, said guide body having an outer end remote from said eccentric of convex spherical shape, a housing means having a surface of concave spherical shape which receives said outer end of convex spherical shape of said guide body and supports the same for swivelling movement, said housing means having an opening which communicates with said surface of concave spherical shape, said opening receiving a pressure medium which applies pressure to said outer end of said guide body, said outer end of said guide body undergoing swivelling movement through an angular travel in opposite directions as said piston undergoes longitudinal travel in said guide body, the improvement wherein:

said outer end of said guide body has an end face which is subjected to the pressure of said pressure medium, said end face being formed to expose a portion of said surface of concave spherical shape of said housing means to said pressure medium during the swivelling movement of said outer end of said guide body through its entire angular travel in opposite directions to produce a force on said end face acting in the longitudinal direction of said guide body of substantially constant magnitude.

2. The improvement as claimed in claim 1, wherein said end face defines a hydraulically effective plane extending perpendicularly to said longitudinal axis of said guide body on which said pressure is applied to produce said force acting in the longitudinal direction of said guide body, said hydraulically effective plane intersection said surface of concave spherical shape during the entire angular travel of said outer end of the guide body in the concave spherical surface of the housing means.

3. The improvement as claimed in claim 1, wherein said end face is a flat surface.

4. The improvement as claimed in claim 1, wherein said guide body extends around said piston so that the piston slides within said guide body.

5. The improvement as claimed in claim 1, wherein the piston slides externally on said guide body.

6. The improvement as claimed in claim 2, wherein said guide body has an inner end subjected to the pressure of said pressure medium, said inner end having an area over which the pressure of said pressure medium is applied, said hydraulically effective plane of said end face having area subjected to the pressure of the pressure medium which is equal to or slightly less than said area of said inner end.

7. The improvement as claimed in claim 3, wherein said outer end of said guide body of convex spherical shape has a width measured in the longitudinal direction of the guide body which is equal to the width of said concave spherical surface.

8. The improvement as claimed in claim 1, wherein said guide body has an annular groove in said convex spherical surface of said outer end in proximity to said end face, and a bore in said guide body communicating with said groove and extending externally of said guide body to communicate with a space for receiving leakage oil.

9. The improvement as claimed in claim 1, wherein said opening in said housing means forms a plane of intersection with said concave spherical surface, said end face of said guide body being disposed on one side of said plane of intersection within said concave spherical surface during the entire angular travel of said guide body in said concave spherical surface.

* * * * *